US008695142B2

(12) United States Patent
Noh et al.

(10) Patent No.: US 8,695,142 B2
(45) Date of Patent: Apr. 15, 2014

(54) PARTIALLY AND FULLY EARTH-ANCHORED CABLE-STAYED BRIDGES USING MAIN-SPAN PRESTRESSING UNIT AND METHOD OF CONSTRUCTING THE SAME

(75) Inventors: Jung Hwi Noh, Gyeonggi-Do (KR); Sang Hoon Lee, Gyeonggi-Do (KR); Jong Heon Park, Seoul (KR); Naeem U. Hussain, Hong Kong (CN); Matt Carter, Hong Kong (CN); Niels J. Gimsing, Kgs. Lyngby (DK)

(73) Assignees: GS Engineering & Construction Corp., Seoul (KR); Ove Arup & Partners Korea Ltd., Seoul (KR)

( * ) Notice: Subject to any disclaimer, the term of this patent is extended or adjusted under 35 U.S.C. 154(b) by 0 days.

(21) Appl. No.: 13/820,147

(22) PCT Filed: Oct. 21, 2010

(86) PCT No.: PCT/KR2010/007232

§ 371 (c)(1),
(2), (4) Date: Mar. 1, 2013

(87) PCT Pub. No.: WO2012/030018

PCT Pub. Date: Mar. 8, 2012

(65) Prior Publication Data

US 2013/0160224 A1 Jun. 27, 2013

(30) Foreign Application Priority Data

Sep. 2, 2010 (KR) ..... 10-2010-0086197

(51) Int. Cl.

| | |
|---|---|
| ***E01D 11/04*** | (2006.01) |
| ***E01D 21/00*** | (2006.01) |
| ***E01D 21/10*** | (2006.01) |

(52) U.S. Cl.

CPC ..... *E01D 21/105* (2013.01)
USPC ..... 14/77.1; 14/21

(58) Field of Classification Search

CPC ..... E01D 11/04; E01D 21/00; E01D 21/105
USPC ..... 14/18–23, 74–75, 77.1
See application file for complete search history.

(56) References Cited

U.S. PATENT DOCUMENTS 4,987,629 A * 1/1991 Muller ..... 14/6
5,208,932 A * 5/1993 Muller ..... 14/21

(Continued)

OTHER PUBLICATIONS

Won et al., "Structural Effects of Partially Earth-anchored Cable System on Medium-span Cable-stayed Bridges", Steel Structures, 2008, p. 225-236, Vo. 8.

*Primary Examiner* — Raymond W Addie
(74) *Attorney, Agent, or Firm* — Jianq Chyun IP Office

(57) ABSTRACT

Provided are partially and fully earth-anchored cable-stayed bridges, each of which uses a prestressing unit including anchor units and a prestressing member from deck segments installed at its main span such that the prestressing unit serves as a conventional windproof cable and can simultaneously introduce a tensile stress. Thereby, a magnitude of the maximum compressive stress acting on a cross section of each main-span deck segment is reduced, so that it is possible to reduce a cross-sectional area of each main-span deck segment and thus to ensure economical construction. All or part of the compressive stress generated at the main span can be offset by the tensile stress caused by the prestressing member.

8 Claims, 8 Drawing Sheets

(56) References Cited

U.S. PATENT DOCUMENTS

| | | | | |
|---|---|---|---|---|
| 5,896,609 | A * | 4/1999 | Lin | 14/20 |
| 6,292,967 | B1 * | 9/2001 | Tabatabai et al. | 14/22 |
| 6,301,735 | B1 * | 10/2001 | Jartoux et al. | 14/22 |
| 6,728,987 | B1 * | 5/2004 | Hinman | 14/77.1 |
| 6,785,925 | B1 * | 9/2004 | Donaldson | 14/22 |
| 7,240,389 | B2 * | 7/2007 | Kim | 14/74.5 |
| 7,743,444 | B2 * | 6/2010 | Murakoshi et al. | 14/18 |
| 7,827,642 | B2 * | 11/2010 | Han | 14/74.5 |
| 8,572,787 | B2 * | 11/2013 | Toguchi | 14/18 |
| 2003/0110583 | A1 * | 6/2003 | Stubler et al. | 14/22 |
| 2008/0313825 | A1 * | 12/2008 | Murakoshi et al. | 14/19 |

* cited by examiner

PARTIALLY AND FULLY EARTH-ANCHORED CABLE-STAYED BRIDGES USING MAIN-SPAN PRESTRESSING UNIT AND METHOD OF CONSTRUCTING THE SAME

CROSS-REFERENCE TO RELATED APPLICATION

This application is a 371 of international application of PCT application serial no. PCT/KR2010/007232, filed on Oct. 21, 2010, which claims the priority benefit of Korea application no. 10-2010-0086197, filed on Sep. 2, 2010. The entirety of each of the above mentioned patent applications is hereby incorporated by reference herein and made a part of this specification.

TECHNICAL FIELD

The present invention relates, in general, to partially and fully earth-anchored cable-stayed bridges using a main-span prestressing unit and a method of constructing the same, and more particularly, to partially and fully earth-anchored cable-stayed bridges using a main-span prestressing unit, in which a magnitude of the maximum compressive stress acting on a cross section of each main-span deck segment is reduced using the main-span prestressing unit, thereby making it possible to reduce a cross-sectional area of each main-span deck segment and thus to ensure economical construction, and a method of constructing the same.

BACKGROUND ART

As is generally known in the art, cable-stayed bridges support the deck of a main span using inclined cables installed on a main tower. Due to a possibility of increasing the main span, the cable-stayed bridges have recently been constructed for wide rivers and seas.

The cable-stayed bridges are constructed to sequentially install deck segments on opposite sides of a main tower to form a main span and a side span, wherein the deck segments of the main and side spans are interconnected using cables.

Thus, the deck segments interconnected on the opposite sides are subjected to a compressive stress in a horizontal direction.

In detail, as in FIG. 1*a*, cables 1 interconnect deck segments 2 on opposite sides of each main tower 3 (at main and side spans). As such, among the components of force applied to each cable 1, the horizontal component of force F2 acts on the deck segment 2 as a compressive stress, whereas the vertical component of force F1 acts upwards.

The compressive stress is maximal at a point M where each main tower 3 is installed, and is zero at the middle point C of a main span. This is because, as the deck segments 2 begin to be installed from the main tower, the applied compressive stress is accumulated and increased on the deck segments 2.

Thus, the maximum compressive stress applied to the deck segments 2 is increased in proportion to the main span L, i.e. a distance between the main towers 3.

FIG. 1*b* is a graph showing a relationship between the maximum compressive stress and the main span L. This graph is obtained on the assumption that a cross-sectional area of each deck segment 2 of the main span is constant.

For example, it can be found that the maximum compressive stress is 160 MPa when the main span L is 1000 m, but it is increased to 500 MPa when the main span L is 2000 m.

In order to cope with the increase of the compressive stress, the deck segments 2 must be formed of high-strength steel, or be increased in cross-sectional area.

Among these methods, the former can cope with the increase of the compressive stress to some extent. However, if the main span L approaches 2000 m, the mere use of the high-strength steel fails to sufficiently resist the applied compressive stress.

Furthermore, due to the applied compressive stress, local buckling may be generated from the deck segments 2 formed of high-strength steel. To prevent the local budding, stiffeners (e.g. longitudinal and transverse ribs) are densely disposed inside the deck segment 2. Thus, a dead load of the deck segment 2 is increased. For this reason, the cables 1 and the main towers 3 are designed on the basis of the deck segments 2 whose dead load is increased, which leads to an increase in size.

Further, the maximum compressive stress occurs at the place M where each main tower 3 is installed. As in FIG. 1*a*, since the magnitude of the compressive stress is gradually reduced around each main tower 3, a range B where the stiffeners for preventing the local buckling are required to be installed becomes relatively wide. Thus, a working process of the deck segments 2 accompanied with the installation of the stiffeners becomes complicated.

Meanwhile, Table 1 below compares amounts of steel required to build an earth-anchored suspension bridge and a self-anchored cable-stayed bridge as in FIG. 1*c* according to the main span L.

(Generally, a bridge called a "cable-stayed bridge" is used herein to refer to a "self-anchored cable-stayed bridge" for comparison with the "partially and fully earth-anchored cable-stayed bridge" according to the present invention. It should be considered in Table 1 that a unit cost of steel required for the cables of the self-anchored cable-stayed bridge is higher than that of steel required for the cables of the earth-anchored suspension bridge, and that a unit cost of steel required for the main span and the main towers of the earth-anchored suspension bridge is higher than that of steel required for the main span and the main towers of the self-anchored cable-stayed bridge.)

TABLE 1

| Type | | Steel for cables | Steel for main span and main towers |
|---|---|---|---|
| Main span (L): 1000 m | Earth-anchored suspension bridge | 7,500 t | 23,000 t |
| | Self-anchored cable-stayed bridge | 3,900 t | 25,000 t |
| Main span (L): 2000 m | Earth-anchored suspension bridge | 36,000 t | 55,000 t |
| | Self-anchored cable-stayed bridge | 19,000 t | 94,000 t |

As shown in Table 1, it can be found that the self-anchored cable-stayed bridge having the main span L between 1500 m and 2000 m does not draw economical attraction compared to the earth-anchored suspension bridge.

This is because, as the main span L increases, the compressive stress acting on each deck segment of the main span increases, and thus the cross-sectional area of each deck segment of the main span must be increased. As a result, an amount of required materials (steel) is also increased.

Recently, many long span bridges have been constructed to cross wide rivers or seas. If the magnitude of the compressive stress acting on the cross section of each deck segment of the main span can be reduced even when the main span is increased at the self-anchored cable-stayed bridge constructed as the long span bridge, it can be seen that this requirement is essential regarding economical construction of the self-anchored cable-stayed bridge.

For this reason, various studies have been made of a method capable of economically constructing the self-anchored cable-stayed bridge, i.e. reducing the magnitude of the compressive stress acting on the cross section of each deck segment. Among the studies, FIG. 1*d* shows a method proposed in 2006 by Prof Gimsing.

In detail, two main towers 3 are constructed. Then, one end of a tension cable 6 is connected to an anchorage 5 installed on the side of a side span of each main tower via the top of the main tower, and the other end of the tension cable 6 extends from each main tower toward the main span and is connected to central deck segments 4 located at a middle part of the main span.

Thus, it can be found that a tensile stress T is generated from the central deck segments 4 by the tension cable 6, and that a compressive stress C is generated by the cables from the compressive deck segments, which are connected with the tensile deck segments 4 and are installed in sections L2 from which the tensile deck segments 4 are excluded, without generating an excessive compressive stress as in the related art. As a result, it can be found that it is possible to reduce the cross-sectional area of each deck segment to economically construct the self-anchored cable-stayed bridge.

Here, a process of installing the tension cable 6 and the central deck segments 4 will be described below.

First, as in FIG. 1*e*, a first main tower 3 and a second main tower 3' are installed apart from a predetermined distance L, and first and second anchorages 5 and 5' are installed.

Here, the first anchorage 5 is a reinforced concrete structure installed on the ground G located outside the side span apart from the first main tower 3.

Further, the second anchorage 5' is a reinforced concrete structure installed on the ground G located outside the side span apart from the second main tower 3'

Continuously, a temporary ropeway 7 is installed to connect the first and second main towers 3 and 3', and tension cables 6 are installed using the temporary ropeway 7.

To install the tension cables 6, a moving device 8 traveling along the temporary ropeway 7 may be used. The tension cables 6 are moved to the middle between the first and second main towers 3 and 3' using the moving device 8, and then are hinged to opposite sides of a connection member 9 that is detachably mounted on a lower portion of the moving device 8.

Thus, as in FIG. 1*f*, the tension cables 6 can be connected by the connection member 9 separated from the moving device 8, thereby sagging in a downward direction.

Meanwhile, the opposite ends of the connected tension cable 6 are anchored to the first and second anchorages 5 and 5'.

After the tension cables 6 are hinged to the opposite sides of the connection member 9, a deck segment 21 is moved to the middle of the main span using the moving device 8 as in FIG. 1*g*. The tension cables 6 coupled to the connection member 9 are connected to the deck segment 21, and then the connection member 9 is removed.

After the deck segment 21 is installed, other deck segments 22 and 23 are installed on opposite sides of the deck segment 21 using the moving device (not shown) as in FIG. 1*h*.

Here, the deck segment 22 installed on one side of the deck segment 21 is connected to the first anchorage 5 by the tension cable 6, and the deck segment 23 installed on the other side of the deck segment 21 is connected to the second anchorage 5' by the tension cable 6. Thus, it can be found that the deck segments 21, 22 and 23 are pulled in opposite directions by the tensile tables 6, and are subjected to a tensile stress T as in FIG. 1*i*.

Meanwhile, as in FIG. 1*i*, deck segments 40 are installed on the opposite sides of the first and second main towers 3 and 3'.

The deck segments 40 on the opposite sides of the first main tower 3 are mutually connected by respective compressive cables 50, and are each subjected to a compressive stress C applied to the first main tower 3 by the horizontal component of force generated from each compressive cable 50.

As in the first main tower 3, the deck segments 40 on the opposite sides of the second main tower 3' are mutually connected by respective compressive cables 50, and are each subjected to a compressive stress C applied to the second main tower 3' by the horizontal component of force generated from each compressive cable 50.

Then, the deck segments 21, 22 and 23 are connected with the deck segments 40 on the opposite sides of the first main tower 3, and the deck segments 21, 22 and 23 are connected with the other deck segments 40 on the opposite sides of the second main tower 3'. Thereby, a self-anchored cable-stayed bridge 10 can be finished.

Consequently, the method of constructing the self-anchored cable-stayed bridge has an advantage in that it can generate the tensile stress T at the main span to reduce the compressive stress C acting on the entire self-anchored cable-stayed bridge, and a disadvantage in that it is somewhat complicated and it is not easy to control the tensile stress T at the main span.

Further, as shown in FIG. 1*i*, windproof cables 60 are installed to restrict positions of the deck segments during construction of the self-anchored cable-stayed bridge, because the deck segments are subjected to vibration and displacement in vertical and horizontal directions by wind.

Typically, a method of installing blocks on an underwater ground below the deck segments, connecting one end of the windproof cable to the block, and connecting the other end of the windproof cable to the deck segment is used.

However, to install the windproof cables 60, the blocks are submerged in the water. This leads to poor constructability. The windproof cables 60 obstruct the passage of ships on the water, i.e. have a possibility of causing safety accidents. In terms of characteristics of the self-anchored cable-stayed bridge, it is for the most part difficult to avoid installing the windproof cables 60. Thus, there is a need for technological development of a method capable of replacing this construction.

DISCLOSURE

Technical Problem

Accordingly, the present invention has been made in an effort to solve the problems occurring in the related art, and an object of the present invention is to provide a method of constructing a cable-stayed bridge capable of reducing a magnitude of the maximum compressive stress applied to each deck segment, and particularly, more effectively applying a tensile stress to each deck segment installed at mid-span, easily controlling the tensile stress, serving as a conventional windproof cable, and securing constructability and workability.

Technical Solution

As described above, the cable-stayed bridge of the related art is subjected to the maximum compressive stress at a point where a main tower is located, wherein the maximum compressive stress is increased in proportion to the main span. As the main span increases, each main-span deck segment must increase its cross section or use high-strength steel in order to reinforce the cross section of each main-span deck segment. For this reason, if the main span exceeds a range of 1200 m to 2000 m, the cable-stayed bridge has poor economical efficiency.

To solve this problem, a cable-stayed bridge of the present invention is designed to cause a tensile stress to be applied to each deck segment at the middle part of a main span, so that a method of constructing the cable-stayed bridge can reduce the maximum compressive stress applied to each deck segment around a main tower.

According to a first exemplary embodiment of the present invention, there is provided a method of constructing a partially earth-anchored cable-stayed bridge using a main-span prestressing unit, in which a tensile stress is applied to each main-span deck segment, so that it is possible to reduce the maximum compressive stress applied to each deck segment located around a main tower.

The method includes: (a) installing first and second main towers a predetermined distance apart from each other in an axial direction of the bridge, a first anchorage on a side of a side span outside the first main tower, and a second anchorage on a side of a side span outside the second main tower; (b) connecting first side-span and main-span deck segments, which extend from the first and second main towers toward the side spans and a middle part of a main span, to compression cables connected to the first and second main towers such that the first main-span deck segments are separated in the axial direction of the bridge without interconnection at the main span; (c) connecting tension cables, which extend from the first and second anchorages toward the main span via the first and second main towers, to second and third main-span deck segments, which are additionally connected to the first main-span deck segments connected by the compression cables; (d) installing first and second anchor units on the second and third main-span deck segments; and (e) mounting a prestressing member including a steel stranded cable between the first and second anchor units so as to cause the first and second main-span deck segments separated in the axial direction of the bridge at the main span to be connected in the axial direction of the bridge, and prestressing and anchoring the prestressing member to cause a tensile stress to be applied to the first and second main-span deck segments.

According to a second exemplary embodiment of the present invention, there is provided a method of constructing a fully earth-anchored cable-stayed bridge using a main-span prestressing unit. The method includes: (a) installing first and second main towers a predetermined distance apart from each other in an axial direction of the bridge, a first anchorage on a side of a side span outside the first main tower, and a second anchorage on a side of a side span outside the second main tower; (b) connecting tension cables, which extend from the first and second anchorages toward a main span via the first and second main towers, to first and second main-span deck segments, which are continuously installed from the first and second main towers to a middle part of the main span in sequence, such that a tensile stress is applied to each main-span deck segment; (c) connecting the first and second main-span deck segments, which are continuously installed from the first and second main towers, to each other at the middle part of the main span, using a prestressing member installed between first and second anchor units installed on the first and second main-span deck segments respectively, the prestressing member being prestressed and anchored between the first and second anchor units; and (d) installing side-span deck segments from the first and second main towers toward the side spans.

In the first and second exemplary embodiments, the tensile stress is applied to the main-span deck segments by first and second anchorages and tension cables, so that it is possible to further reduce the maximum compressive stress generated around the main tower as a whole.

Further, in the first and second exemplary embodiments of the present invention, the main-span deck segments are connected and restricted in the axial direction of the bridge by the first and second anchor units and the prestressing member, so that it is possible to expect the function as a conventional windproof cable. The tensile stress is applied by prestressing and anchoring of the prestressing members, so that it is possible to effectively control and reduce the magnitude of the maximum compressive stress generated around the main tower.

Further, according to a first exemplary embodiment of the present invention, there is provided a partially earth-anchored cable-stayed bridge, which includes: first and second main towers spaced a predetermined distance apart from each other in an axial direction of the bridge; first and second anchorages on sides of side spans outside the first and second main towers, respectively, first side-span and main-span deck segments, which extend from the first and second main towers toward the side spans and a middle part of a main span and are connected to compression cables connected to the first and second main towers such that the first main-span deck segments are separated in the axial direction of the bridge without interconnection at the main span; first and second anchor units on the second and third main-span deck segments separated in the axial direction of the bridge; and a prestressing member including a steel stranded cable, which is mounted between the first and second anchor units and is prestressed and anchored in connection to the first and second main-span deck segments, wherein the prestressing member applies a tensile stress to the first and second main-span deck segments.

According to a second exemplary embodiment of the present invention, there is provided a fully earth-anchored cable-stayed bridge, which includes: first and second main towers spaced a predetermined distance apart from each other in an axial direction of the bridge; first and second anchorages on sides of side spans outside the first and second main towers; tension cables, which extend from the first and second anchorages toward a main span via the first and second main towers, and are connected to first and second main-span deck segments, which are continuously installed from the first and second main towers to a middle part of the main span in sequence, such that a tensile stress is applied to each main-span deck segment; a prestressing member installed between first and second anchor units installed on the first and second main-span deck segments respectively and prestressed and anchored between the first and second anchor units, the first and second main-span deck segments, which are continuously installed from the first and second main towers, being connected to each other at the middle part of the main span; and side-span deck segments installed from the first and second main towers toward the side spans.

Advantageous Effects

The partially earth-anchored cable-stayed bridge and the method of constructing the same according to the present invention have the following effects.

First, it is possible to reduce the magnitude of the maximum compressive stress acting on the cross section of each main-span deck segment between the main towers, and thus to more effectively reduce the cross-sectional area of each main-span deck segment.

Second, since an amount of required structural steel can be reduced by reducing the cross-sectional area of each main-span deck segment, it is possible to secure economical efficiency. Thus, a super long span cable-stayed bridge can have economical efficiency compared to other bridges.

Third, the first and second anchor units and the prestressing members according to the first and second exemplary embodiments of the present invention can serve to restrict, for instance, vibration affected by wind etc. due to suspension between the main towers by the cables (a windproof function), so that they can be easily manufactured and installed compared to a method of installing a conventional windproof cable, and not obstruct passage of ships, etc.

Fourth, since the prestressing member of the present invention can control a magnitude of introduced pre-stress using a hydraulic jack, etc. having easy transportability, it is possible to effectively control the magnitude of the tensile stress applied at the main span, and thus to design precise deck segments.

BEST MODE

Hereinafter, exemplary embodiments of the present invention will be described in greater detail with reference to the accompanying drawings. Here, the terminology or words used in the specification and the claims of the present invention should not be interpreted as typical or lexical meanings, and they should be interpreted as the meaning and concept conforming to the technological idea of the present invention on the basis of the idea that the inventor can define the concept of the words appropriately in order to illustrate his invention in the best manner. While the present invention is particularly shown and described with reference to the exemplary embodiment, it will be understood by those skilled in the art that various changes and modifications can be made within the spirit and the scope of the present invention, and accordingly, the scope of the present invention is not limited within the described range but the following claims and the equivalents thereof.

A method of constructing a partially earth-anchored cable-stayed bridge according to first and second exemplary embodiments of the present invention will be sequentially described below. Further, the description of the constructing method will be accompanied with a description of the partially earth-anchored cable-stayed bridge.

First Exemplary Embodiment

Partially Earth-Anchored Cable-Stayed Bridge and Method of Constructing the Same In the present invention, a cable-stayed bridge 100 is installed as a super long span bridge, whose main span is based on a range of about 1200 m to about 2000 m.

Figure 2A:
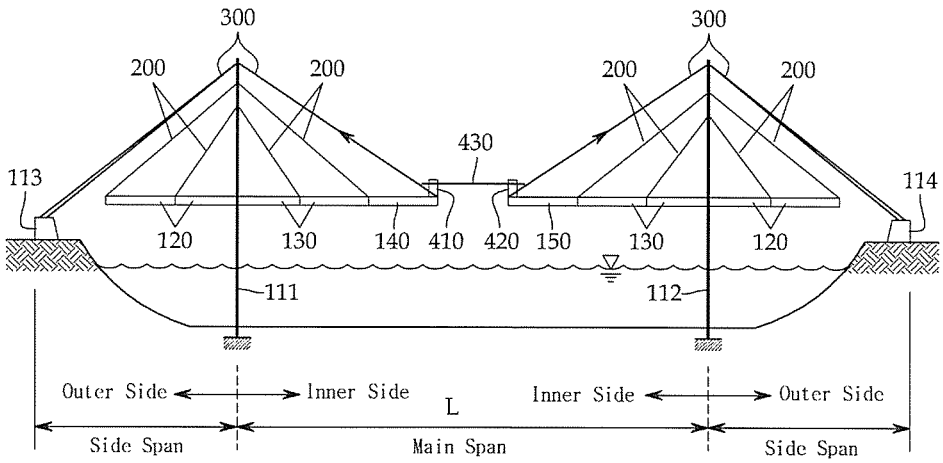
FIGS. 2*a*, 2*b* and 2*c* illustrate a constructing process and stress distribution of a partially earth-anchored cable-stayed bridge according to a first exemplary embodiment of the present invention.
Figure 2B:
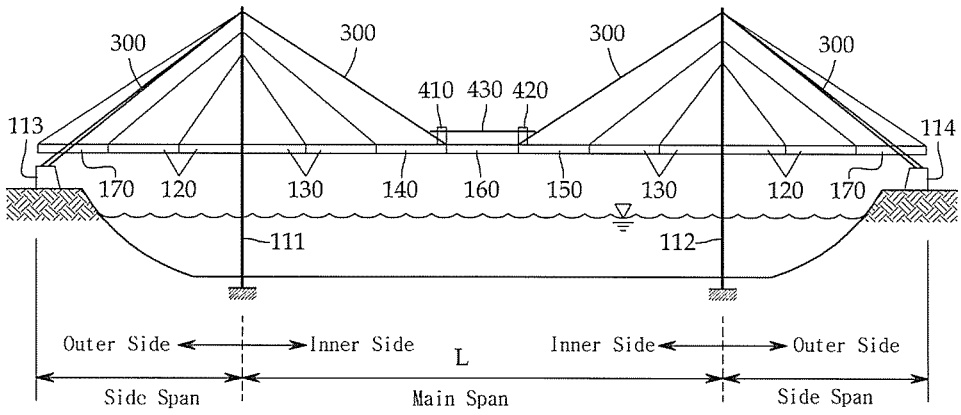
Figure 2C:
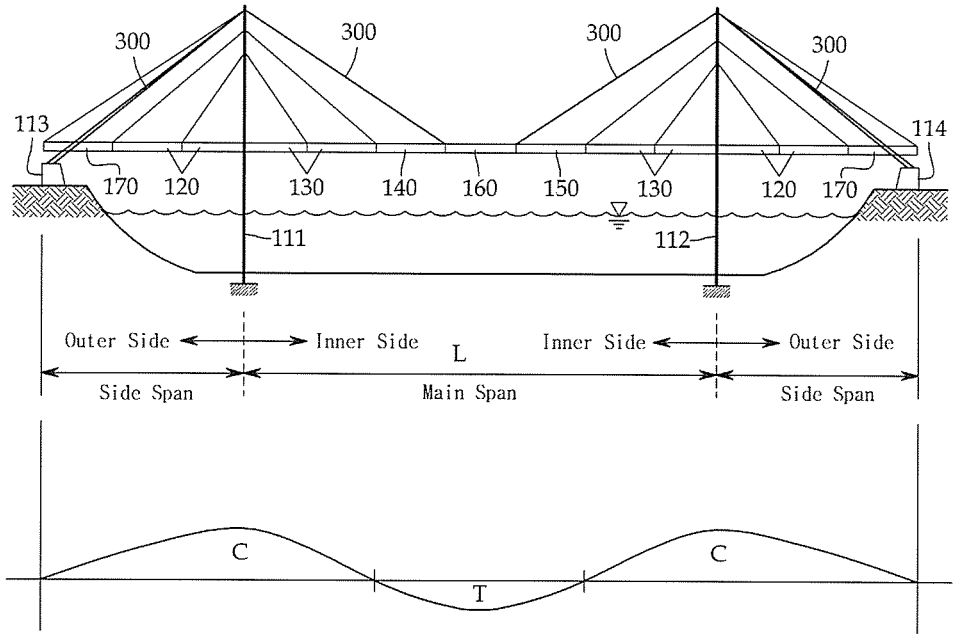

The cable-stayed bridge of the present invention is basically constructed as a partially earth-anchored cable-stayed bridge as in FIGS. 2*a* through 2*c*.

Figure 1A:
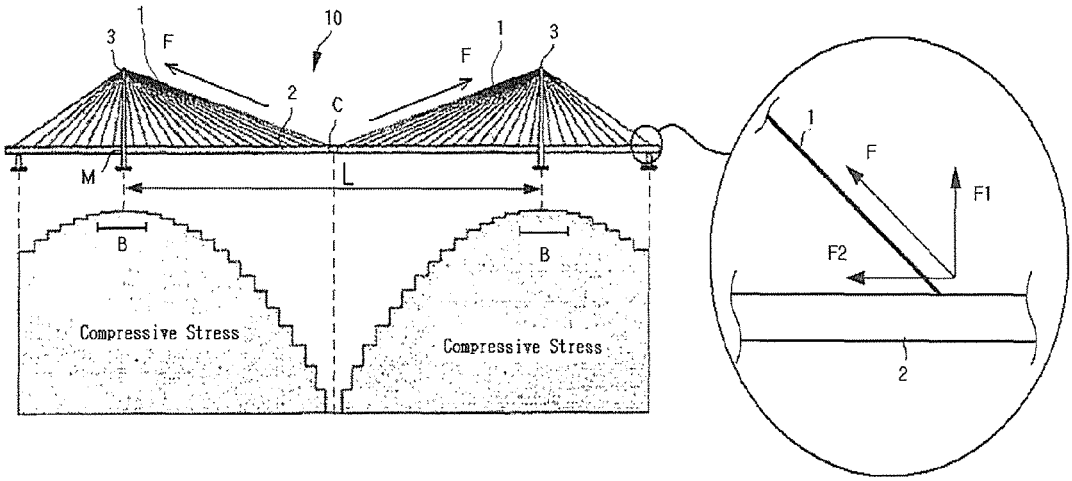
FIG. 1a (RELATED ART)
FIG. 1*a* illustrates a cable-stayed bridge of the related art and distribution of an applied compressive stress.
Figure 1B:
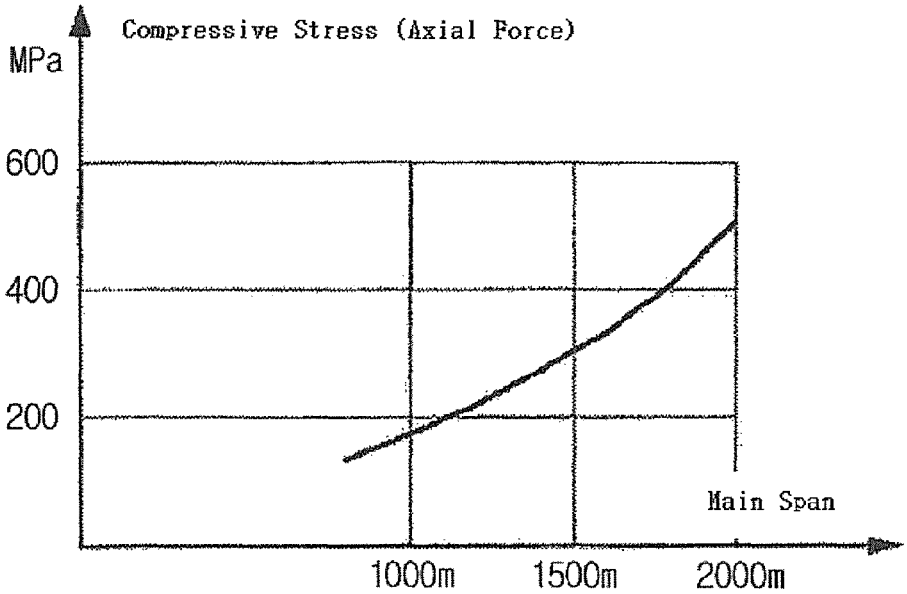
FIG. 1b (RELATED ART)
FIG. 1*b* is a graph showing a relationship between a main span L and a maximum compressive stress applied to each main-span deck segment in a cable-stayed bridge.
Figure 1C:
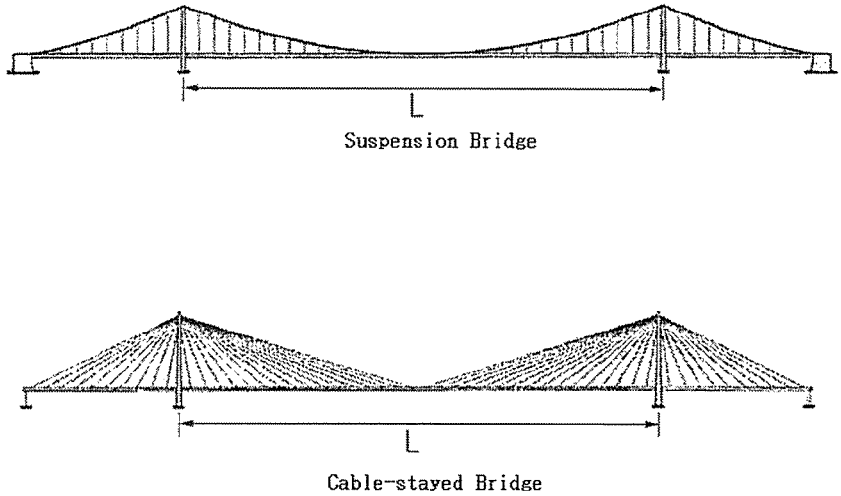
FIG. 1c (RELATED ART)
FIG. 1*c* is a front view illustrating typical suspension and cable-stayed bridges of the related art.
Figure 1D:
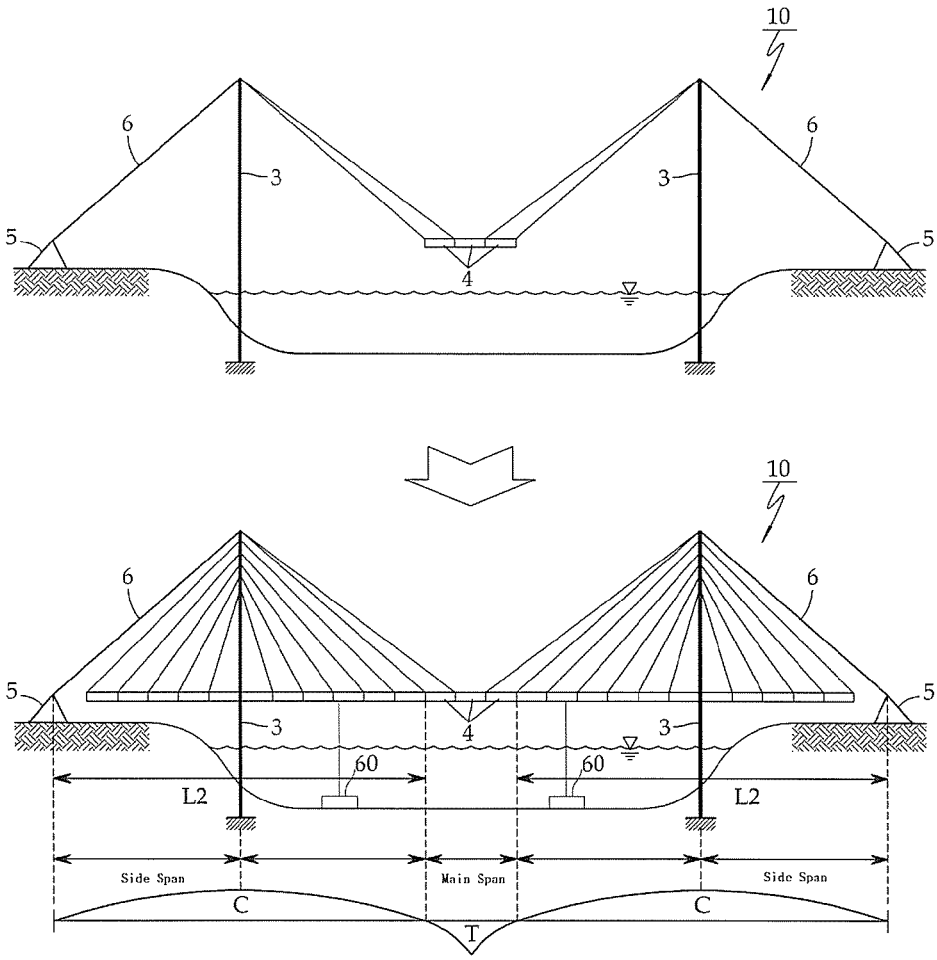
FIG. 1d (RELATED ART)
FIG. 1*d* is a main construction view of a partially earth-anchored cable-stayed bridge of the related art.
Figure 1E:
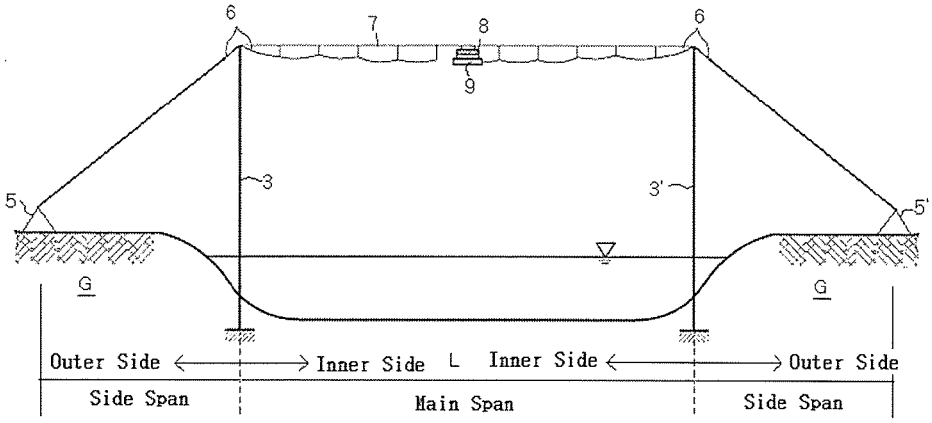
FIGS. 1e (RELATED ART)
FIGS. 1*e*, 1*f*, 1*g*, 1*h* and 1*i* illustrate a process of constructing anchorages in a partially earth-anchored cable-stayed bridge of the related art.
Figure 1F:
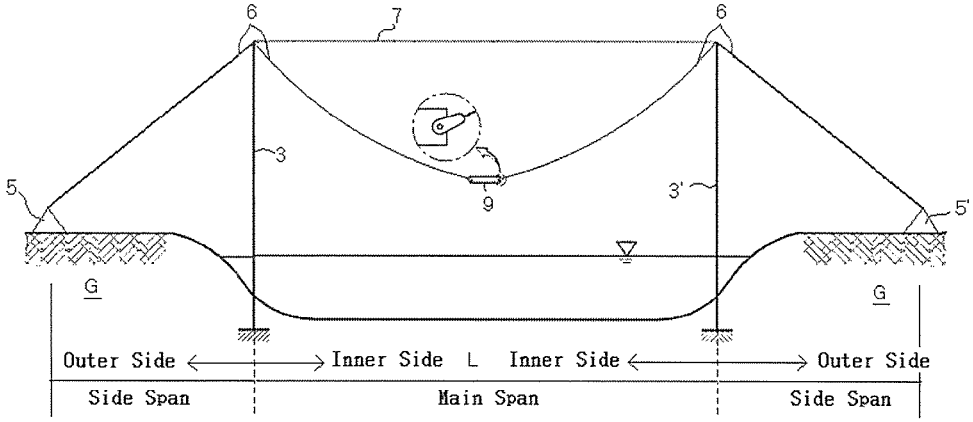
FIGS. 1f (RELATED ART)
Figure 1G:
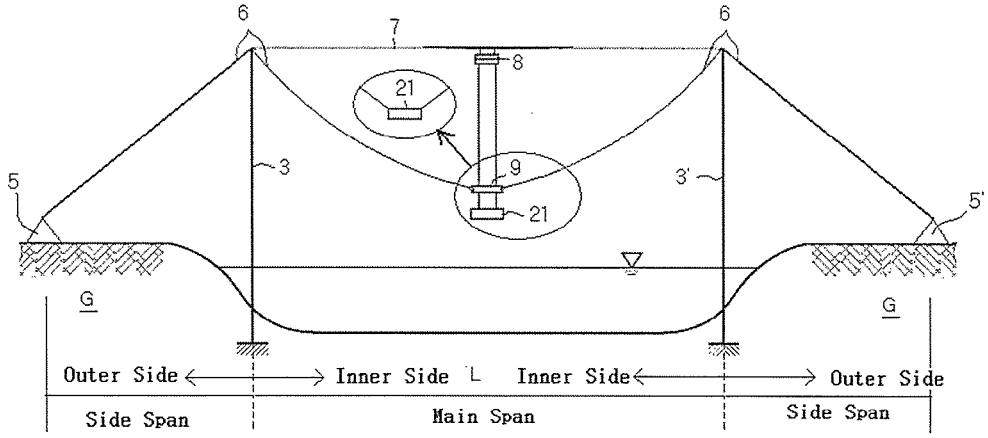
FIGS. 1g (RELATED ART)
Figure 1H:
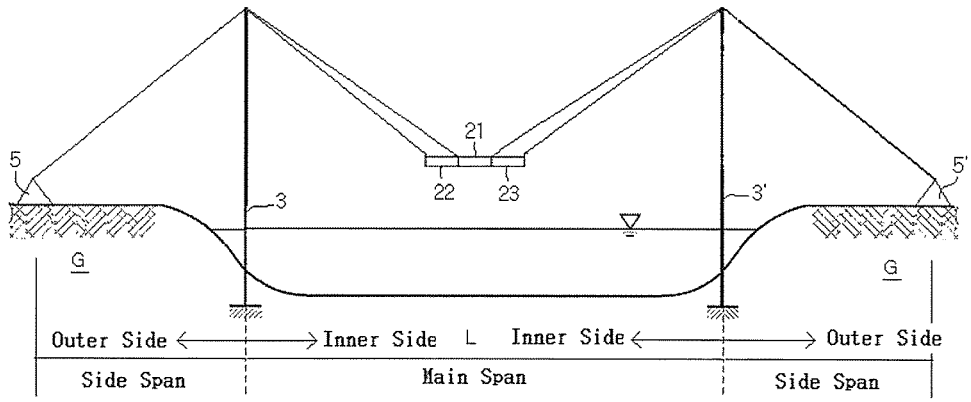
FIGS. 1h (RELATED ART)
Figure 1I:
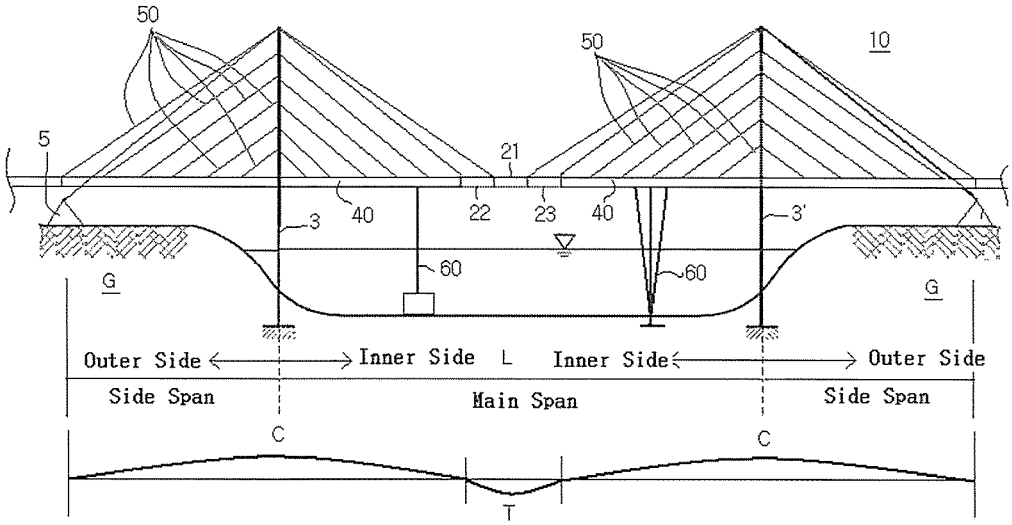
FIGS. 1i (RELATED ART)

The reason for constructing the bridge in this way is ultimately to allow a tensile stress to be generated by the deck segments in a predetermined section (e.g. a central part) of the main span as in FIG. 1*d*, thereby reducing the magnitude of a maximum compressive stress throughout the cable-stayed bridge.

Now, an example of constructing the partially earth-anchored cable-stayed bridge will be described below.

First, as in FIG. 2*a*, a first main tower 111 and a second main tower 112 are installed a predetermined distance L apart from each other, and first and second anchorages 113 and 114 are installed.

Here, the first anchorage 113 may be a reinforced concrete structure installed on the ground located on the side of a side span outside the first main tower 111, and may be variously implemented. Further, the first anchorage 113 may be installed under water. The first anchorage 113 is not substantially limited in its position as long as it is located on the side of the side span outside the first main tower.

Similarly, the second anchorage 114 may be a reinforced concrete structure installed on the ground located on the side of a side span outside the second main tower 112, and may be variously implemented. The second anchorage 114 may also be installed under water. The second anchorage 114 is not substantially limited in its position as long as it is located on the side of the side span outside the second main tower.

Next, first side-span deck segments 120 and first main-span deck segments 130 are installed to extend from the first main tower 111 and the second main tower 112 toward the side span and the middle of the main span, respectively. To this end, the first side-span and main-span deck segments 120 and 130 are connected by compression cables 200 connected to the first and second main towers 111 and 112. However, the first main-span deck segments 130 of the first and second main towers are not yet connected to each other at the main span, i.e. are separated from each other in an axial direction of the bridge.

Thus, the first side-span and main-span deck segments 120 and 130 are installed to be suspended to the first and second main towers by the cables, so that a compressive stress is generated as in the related art. Herein, because the deck segments by which the compressive stress is generated are connected to the first and second main towers by the cables, the cables are referred to as compression cables.

Next tension cables 300 are installed to extend from the first and second anchorages 113 and 114) toward the main span via the first and second main towers 111 and 112. The tension cables 300 are connected to second and third main-span deck segments 140 and 150, which are additionally connected to the first main-span deck segments 130 connected by the compression cables respectively.

After being connected to the first main-span deck segments 130, the second and third main-span deck segments 140 and 150 are connected by the tension cables 300 connected to the first and second anchorages 113 and 114. Thus, it can be found that a compressive stress is generated.

Further, it can be found that the compressive stress generated by the first side-span and main-span deck segments 120 and 130 is accumulated by the compressive stress generated by the second and third main-span deck segments 140 and 150. As such, in the present invention, prestressing members 430 (described below) are installed, thereby offsetting the compressive stress.

Furthermore, in the present invention, first and second anchor units 410 and 420 are to installed on the second and third main-span deck segments 140 and 150.

Each of the first and second anchor units 410 and 420 includes an anchor and a hydraulic jack for prestressing and anchoring, for instance, a prestressed concrete (PC) steel stranded cable. The unit itself may use something typically available on the market such as the PC steel stranded cable for bridges.

Each deck segment is typically made of steel, and each of the first and second anchor units 410 and 420 is preferably installed on an upper surface of the deck segment so as to be able to secure prestressing and anchoring workability of the prestressing members in the future.

It is apparent that the anchor unit is installed on the deck segment at a position where no hindrance or interference occurs when the deck segment is lifted at the main span using, for instance, a barge, and then is connected to the other deck segment installed previously.

Next, the prestressing members 430 including a steel stranded cable are installed between the first and second anchor units 410 and 420, and the second and third main-span deck segments 140 and 150 separated from each other at the main span in the axial direction of the bridge are interconnected in the axial direction of the bridge. In this state, the prestressing members 430 are prestressed and anchored to cause a tensile stress to be applied to the second and third main-span deck segments.

Here, a steel rod may be used for each prestressing member 430. However, the steel rod is not easy to treat, and thus the steel stranded cable may be used. Opposite ends of each prestressing member 430 are prestressed and anchored to the first and second anchor units 410 and 420.

FIG. 2*a* shows one prestressing member 430 installed between the paired second and third main-span deck segments 140 and 150. However, the number of installed prestressing members may vary, and a position of the prestressing member installed on the anchor units may vary as well.

Figure 4A:
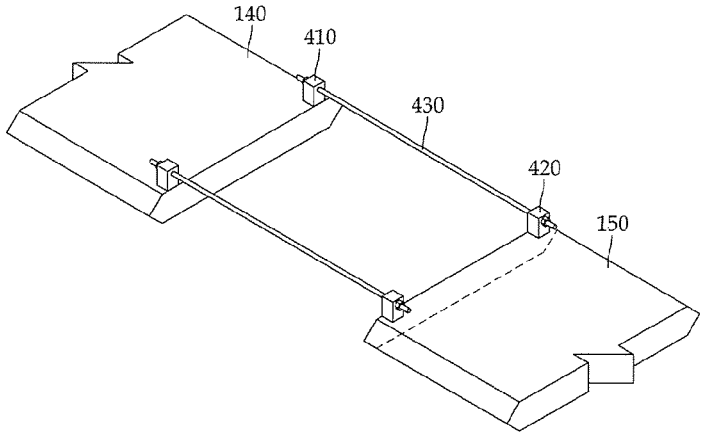
FIGS. 4*a* and 4*b* are perspective views illustrating an example of installing anchor units and prestressing member (s) of the present invention.
Figure 4B:
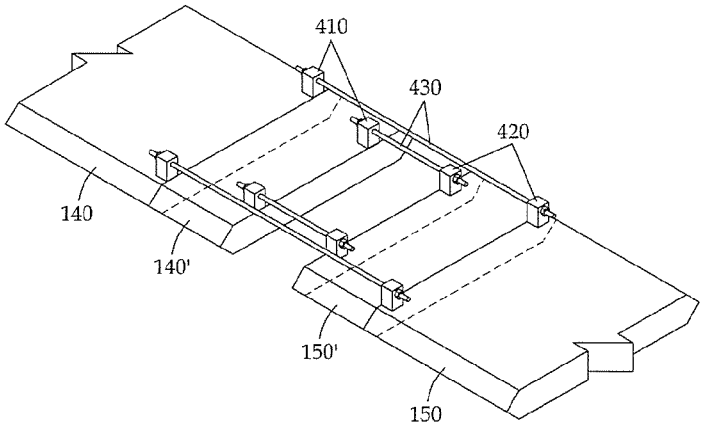

FIGS. 4*a* and 4*b* show examples of installing the prestressing members 430.

In detail, it can be seen from FIG. 4*a* that the first and second anchor units 410 and 420 are installed on the second and third main-span deck segments 140 and 150 respectively, and that the prestressing members 430 are installed between the first and second anchor units 410 and 420.

Further, it can be seen from FIG. 4*b* that additional second and third main-span deck segments 140' and 150' are installed between the second and third main-span deck segments 140 and 150 and that other prestressing members 430' are additionally installed on the additional second and third main-span deck segments 140' and 150'.

In other words, it can be found that the number of installed prestressing members 430 and 430' of the present invention is one, two or more depending on the number of installed second and third main-span deck segments 140 and 140' and 150 and 150'.

To dispose the prestressing members on the anchor units separated from each other, a variety of methods may be used. For example, supports such as brackets may be temporarily installed between the anchor units, and temporary installation cables may be connected between the supports. Then, a deck truck carrying the prestressing members may be installed on the temporary installation cables, and move to the opposite side along the temporary installation cables. Thereby, the prestressing members may be anchored to the anchor units.

In the present invention, each prestressing member 430 performs two functions.

First, each prestressing member 430 acts as a windproof cable of the related art. In detail, the prestressing members 430 are installed between the first and second anchor units 410 and 420, and function to mutually connect the second and third main-span deck segments 140 and 150, so that they can prevent vibration caused by, for instance, wind acting on the deck segments connected by the cables.

Thus, in comparison with the windproof cables 60 installed as in FIG. 1*d* of the related art, installation is simple. Particularly, in a cable-stayed bridge installed as a land bridge, the prestressing members do not obstruct the passage of ships, compared to the windproof cables connected to the blocks in the water.

Second, the prestressing members 430 are prestressed by, for instance, a hydraulic jack, and then are anchored to the first and second anchor units 410 and 420, thereby causing a tensile stress to be generated in the second and third main-span deck segments 140 and 150. This tensile stress offsets a compressive stress generated from the tension cable 300. Due to the use of the hydraulic jack, it is possible to more easily control the magnitude of the tensile stress introduced.

Accordingly, in the present invention, the anchor units and the prestressing members function to introduce the tensile stress into the deck segments installed at the main span.

It can be checked from FIGS. 4*a* and 4*b* that the connection and tensile stress introduction of the main-span deck segments using the anchor units and the prestressing members can be repeated until all the main-span deck segments are installed at the main span.

Thus, it can be found from FIG. 2*b* that a fourth main-span deck segment 160 is finally installed between the second and third main-span deck segments 140 and 150.

Next, as in FIG. 2*b*, compression cables 200 are additionally installed on the first and second main towers 111 and 112, and thus side-span deck segments 170 are additionally installed within the side spans. Thereby, the deck segments are finally installed at the cable-stayed bridge.

Of course, the first and second anchor units 410 and 420 and the prestressing members 430 are ultimately removed, so that the connection of the deck segments at the cable-stayed bridge can be completed as in FIG. 2*c*.

As in FIG. 2*c*, at the cable-stayed bridge of the present invention, since the second, third and fourth main-span deck segments 140, 150 and 160 installed in a predetermined section of the main span are pulled toward the first and second main towers 111 and 112 by the tension cables 300 by way of the first and second main towers 111 and 112, a tensile stress T is generated.

Meanwhile, the first main-span deck segments 130 are interconnected by the compression cables 200 installed on the first and second main towers 111 and 112, and thus a compressive stress C is generated.

As a result, it can be found that the tensile stress is generated in the main-span deck segments 140, 150 and 160 at the central part of the main span, while the compressive stress is generated in the side-span deck segments 120, 170 of the first and second main towers 111 and 112, and the first main-span deck segments 130 of the first and second main towers.

In FIG. 2*c*, "C" indicates the compressive stress, and "T" indicates the tensile stress.

With this configuration, the present invention has the following effects.

First, in comparison with the maximum compressive stress acting on the cross section of each main-span deck segment between the main towers 111 and 112 (FIG. 1*d*), the magnitude of the maximum compressive stress can be reduced, so that the cross-sectional area of each main-span deck segment can be more effectively reduced.

Second, since an amount of required structural steel can be reduced by reducing the cross-sectional area of each main-span deck segment, it is possible to secure economical efficiency. Thus, a super long span cable-stayed bridge can have economical efficiency compared to other bridges.

Third, the tensile stress can be introduced into some of the main-span deck segments, which are installed at a middle part of the main span, by the tension cables, the anchor units, and the prestressing members. Thus, it is possible to easily control the magnitude of the introduced tensile stress.

Fourth, the anchor units and the prestressing members interconnect and restrict the main-span deck segments, and thus serve as the windproof cables of the related art.

Thus, according to a quantitative test, when the side span is appropriate (e.g. when a ratio of the side span to the main span L is about 1:2 or 1:2.5), the maximum compressive stress is reduced by about half or more, compared to that of an existing cable-stayed bridge.

Here, to further reduce the weight, cables having a higher strength-to-density ratio than steel cables may be used for the tension or compression cables.

For example, a tension or compression cable made of carbon fiber has weight per unit force of about ¼ that of a steel cable, and about 1/10 that of high-strength structural steel.

The use of the carbon fiber cable is suitable to reduce the weight. Since the carbon fiber cable is disposed in the deck segment, it can be well protected, and enable convenient testing and relocation.

Figure 5:
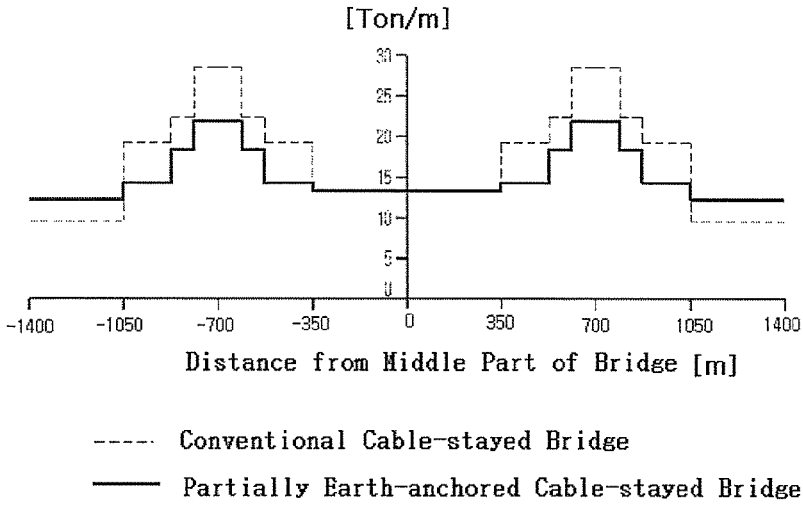
FIG. 5 is a graph showing an amount of steel required for deck segments of the present invention and an amount of steel required for deck segments of the related art.

FIG. 5 schematically shows an amount of steel required constructing a partially earth-anchored cable-stayed bridge and that required constructing a conventional cable-stayed bridge on the basis of a span (main span plus side span).

In FIG. 5, the solid line represents the cable-stayed bridge of the present invention, and the dashed line represents the conventional cable-stayed bridge. Further, the x axis (transverse axis) represents the distance (m) from the middle of the bridge.

Referring to FIG. 5, the cable-stayed bridge 100 or 10 requires the greatest amount of steel at places (−700 m, 700 m) including the main towers. This is because the maximum compressive stress occurs at the places including the main towers.

It can be found that, since the cable-stayed bridge of the present invention has a smaller maximum compressive stress than the cable-stayed bridge of the related art, an amount of required steel is remarkably small, compared to the cable-stayed bridge of the related art.

Second Exemplary Embodiment

Fully Earth-Anchored Cable-Stayed Bridge and Method of Constructing the Same In the first exemplary embodiment of the present invention, the tensile stress is generated in a predetermined section where some of the main-span deck segments are installed. In contrast, in the second exemplary embodiment of the present invention, the tensile stress is generated in all the main-span deck segments.

An example of constructing this fully earth-anchored cable-stayed bridge will be described below.

Figure 3A:
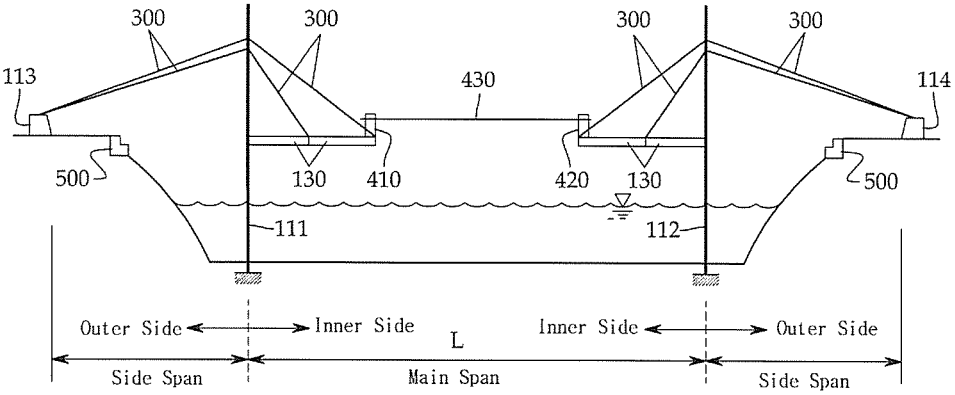
FIGS. 3*a*, 3*b* and 3*c* illustrate a constructing process and stress distribution of a fully earth-anchored cable-stayed bridge according to a second exemplary embodiment of the present invention.

First, as in FIG. 3*a*, a first main tower 111 and a second main tower 112 are installed a predetermined distance apart from each other in the axial direction of a bridge. A first anchorage 113 is installed on the side of a side span outside the first main tower 111, and a second anchorage 114 is installed on the side of a side span outside the second main tower 112.

The first anchorage 113 may be a reinforced concrete structure installed on the ground located on the side of the side span outside the first main tower 111, and may be variously implemented. Further, the first anchorage 113 may be installed under water. The first anchorage 113 is not substantially limited in its position as long as it is located on the side of the side span outside the first main tower.

Similarly, the second anchorage 114 may be a reinforced concrete structure installed on the ground located on the side of a side span outside the second main tower 112, and may be variously implemented. The second anchorage 114 may also be installed under water. The second anchorage 114 is not substantially limited in its position as long as it is located on the side of the side span outside the second main tower.

Next, tension cables 300 extend from the first and second anchorages 113 and 114 toward a main span via the first and second main towers 111 and 112. The tension cables 300 are connected to first main-span deck segments 130 that are sequentially installed from the first and second main towers 111 and 112 to the middle of the main span, thereby applying a tensile stress to the first main-span deck segments 130.

In detail, the first main-span deck segments 130 are continuously installed from the first and second main towers 111 and 112 toward the middle of the main span, and are connected to the tension cables 300 connected to the first and second anchorages 113 and 114. However, since the first main-span deck segments 130 are connected to the first and second main towers 111 and 112, a compressive stress is generated.

Consequently, the cable-stayed bridge of the second exemplary embodiment is configured so that the first main-span deck segments 130 are continuously installed from the first and second main towers 111 and 112 so as to be mutually connected at a middle part of the main span. The connection is carried out by installing prestressing members 430 and 430' between first anchor units 410 and 410' and second anchor units 420 and 420' installed on the first main-span deck segments 130. The prestressing members 430 and 430' are prestressed and anchored between the first anchor units 410 and 410' and the second anchor units 420 and 420'.

In greater detail, the first anchor units 410 and the second anchor units 420 are installed on the corresponding first main-span deck segments 130.

Each of the first and second anchor units 410 and 420 includes an anchor and a hydraulic jack for prestressing and anchoring, for instance, a PC steel stranded cable. The unit itself may use something typically available on the market such as the PC steel stranded cable for bridges.

Each deck segment is typically made of steel, and each of the first and second anchor units 410 and 420 is preferably installed on an upper surface of the deck segment so as to be able to secure prestressing and anchoring workability of the prestressing members in the future.

Next, the prestressing members 430 including a steel stranded cable are installed between the first and second anchor units 410 and 420, and the first main-span deck segments 130 separated from each other at the main span in the axial direction of the bridge are interconnected in the axial direction of the bridge. In this state, the prestressing members 430 are prestressed and anchored to cause a tensile stress to be applied to the first main-span deck segments.

Here, a steel rod may be used for each prestressing member 430. However, the steel rod is not easy to treat, and thus the steel stranded cable may be used. Opposite ends of each prestressing member 430 are prestressed and anchored to the first and second anchor units 410 and 420.

FIG. 3*a* shows one pre-stressing member 430 installed between the paired first main-span deck segments 130. However, the number of installed prestressing members may vary, and a position of the prestressing member installed on the anchor units may vary as well.

Figure 3B:
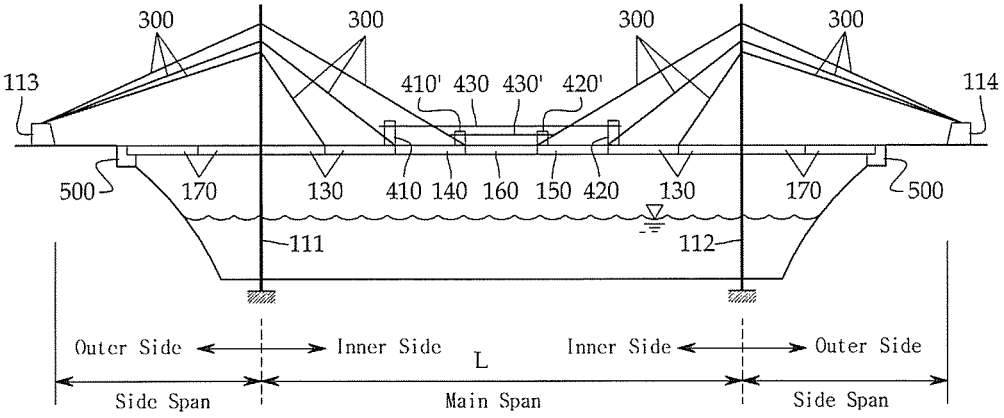

In detail, as in FIG. 3*b*, second, third and fourth main-span deck segments 140, 150 and 160 may be additionally installed between the first main-span deck segments 130. Third and fourth anchor units 410' and 420' may be additionally installed on the second and third main-span deck segments 140 and 150. Other prestressing members 430' may be installed on the third and fourth anchor units 410' and 420'.

In other words, it can be found that the number of installed prestressing members 430 and 430' of the present invention is one, two or more depending on the number of installed second and third main-span deck segments 140 and 150.

To dispose the prestressing members on the anchor units separated from each other, a variety of methods may be used.

In the present invention, the prestressing members 430 and 430' perform two functions.

First, each prestressing member acts as a windproof cable of the related art. In detail, the prestressing members 430 and 430' are installed between the first and second anchor units 410 and 420, and function to mutually connect the second and third main-span deck segments 140 and 150, so that they can prevent vibration caused by, for instance, wind acting on the deck segments connected by the cables.

Thus, in comparison with the windproof cables 60 installed as in FIG. 1*d* of the related art, installation is simple. Particularly, in a cable-stayed bridge installed as a land bridge, the prestressing members do not obstruct the passage of ships, compared to the windproof cables connected to the blocks in the water.

Second, the prestressing members 430 and 430' are prestressed by, for instance, a hydraulic jack, and then are anchored to the first and second anchor units 410 and 420, thereby causing a tensile stress to be generated in the second and third main-span deck segments 140 and 150. This tensile stress offsets a compressive stress generated from the tension cable 300. Due to the use of the hydraulic jack, it is possible to more easily control the magnitude of the tensile stress introduced.

Accordingly, in the present invention, the anchor units and the prestressing members function to additionally introduce the tensile stress into the deck segments installed at the main span.

Next, side-span deck segments 170 are additionally installed from the first and second main towers 111 and 112 to the side spans.

In detail, as in FIG. 3*b*, the main-span deck segments 130, 140, 150 and 160, to which the tensile stress is applied, are installed at the main span. The side-span deck segments 170 are not suspended from the main towers by the cables, but are installed between the first and second main towers and abutments 500 installed around the first and second anchorages.

Figure 3C:
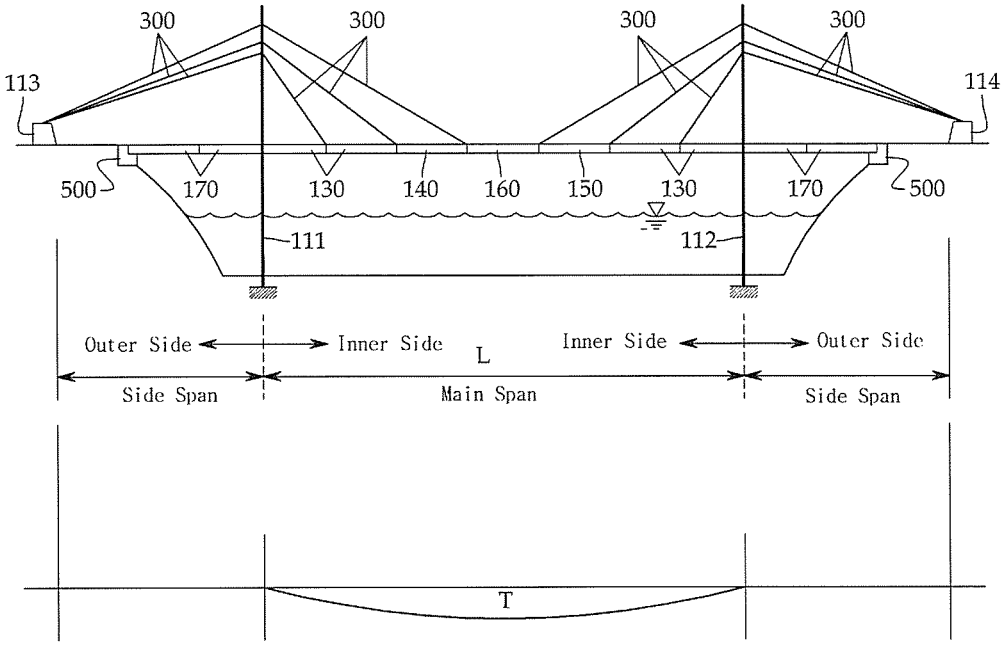

In the second exemplary embodiment, it can be seen from FIG. 3*c* that, since the compressive stress caused by the first and second anchorages 113 and 114 and the tension cables 300 is completely offset by the anchor units and the prestressing members and thus the tensile stress acts on the main-span deck segments, it is possible to further reduce the magnitude of the maximum compressive stress generated around the main towers.

Of course, the magnitude of the tensile stress introduced by the prestressing members may be controlled. Thereby, the second, third and fourth main-span deck segments 140, 150 and 160 installed in a predetermined section of the main span allow the tensile stress to be generated, and the first main-span deck segments 130 from the tension cables 300 going via the first and second main towers 111 and 112 allow the compressive stress to be generated.

In FIG. 3*c*, "T" represents the tensile stress.

Accordingly, the fully earth-anchored cable-stayed bridge according to the second exemplary embodiment of the present invention has the following effects.

First, the maximum compressive stress acting on the cross section of each main-span deck segment between the main towers 111 and 112 becomes zero, and thus only the tensile stress acts on each main-span deck segment. Thus, steel having good resistance to the tensile stress is very favorable in manufacture of the deck segments.

Second, since an amount of required structural steel can be reduced by reducing the cross-sectional area of each main-span deck segment, it is possible to secure economical efficiency. Thus, a super long span cable-stayed bridge can have economical efficiency compared to other bridges.

Third, the tensile stress can be introduced into the main-span deck segments, which are installed at a middle part of the main span, by the tension cables, the anchor units, and the prestressing members. Thus, it is possible to easily control the magnitude of the introduced tensile stress.

Fourth, the anchor units and the prestressing members interconnect and restrict the main-span deck segments, and thus serve as the windproof cables of the related art.

The invention claimed is:

1. A method of constructing a partially earth-anchored cable-stayed bridge using a main-span prestressing unit, the method comprising:

(a) installing first and second main towers a predetermined distance apart from each other in an axial direction of the bridge, a first anchorage on a side of a side span outside the first main tower, and a second anchorage on a side of a side span outside the second main tower;

(b) connecting first side-span and main-span deck segments, which extend from the first and second main towers toward the side spans and a middle part of a main span, to compression cables connected to the first and second main towers such that the first main-span deck segments are separated in the axial direction of the bridge without interconnection at the main span;

(c) connecting tension cables, which extend from the first and second anchorages toward the main span via the first and second main towers, to second and third main-span deck segments, which are additionally connected to the first main-span deck segments connected by the compression cables;

(d) installing first and second anchor units on the second and third main-span deck segments; and (e) mounting a prestressing member including a steel stranded cable between the first and second anchor units so as to cause the first and second main-span deck segments separated in the axial direction of the bridge at the main span to be connected in the axial direction of the bridge, and prestressing and anchoring the prestressing member to cause a tensile stress to be applied to the first and second main-span deck segments.

2. The method as set forth in claim 1, wherein: the first and second anchor units are installed on upper surfaces of the second and third main-span deck segments so as to be opposite to each other in at least one pair between the second and third main-span deck segments; and the second and third main-span deck segments are continuously connected in at least one pair such that the anchor units and the prestressing member are installed in the axial direction of the bridge in multistage.

3. A method of constructing a fully earth-anchored cable-stayed bridge using a main-span prestressing unit, the method comprising:

(a) installing first and second main towers a predetermined distance apart from each other in an axial direction of the bridge, a first anchorage on a side of a side span outside the first main tower, and a second anchorage on a side of a side span outside the second main tower;

(b) connecting tension cables, which extend from the first and second anchorages toward a main span via the first and second main towers, to first and second main-span deck segments, which are continuously installed from the first and second main towers to a middle part of the main span in sequence, such that a tensile stress is applied to each main-span deck segment;

(c) connecting the first and second main-span deck segments, which are continuously installed from the first and second main towers, to each other at the middle part of the main span, using a prestressing member installed between first and second anchor units installed on the first and second main-span deck segments respectively, the prestressing member being prestressed and anchored between the first and second anchor units; and (d) installing side-span deck segments from the first and second main towers toward the side spans.

4. The method as set forth in claim 3, wherein: the first and second anchor units are installed on upper surfaces of second and third main-span deck segments so as to be opposite to each other in at least one pair between the second and third main-span deck segments; and the second and third main-span deck segments are continuously connected in at least one pair such that the anchor units and the prestressing member are installed in the axial direction of the bridge in rows.

5. A partially earth-anchored cable-stayed bridge using a main-span prestressing unit comprising:

first and second main towers spaced a predetermined distance apart from each other in an axial direction of the bridge;

first and second anchorages on sides of side spans outside the first and second main towers, respectively, first side-span and main-span deck segments), which extend from the first and second main towers toward the side spans and a middle part of a main span and are connected to compression cables connected to the first and second main towers such that the first main-span deck segments are separated in the axial direction of the bridge without interconnection at the main span;

first and second anchor units on the second and third main-span deck segments separated in the axial direction of the bridge; and a prestressing member including a steel stranded cable, which is mounted between the first and second anchor units and is prestressed and anchored in connection to the first and second main-span deck segments, wherein the prestressing member applies a tensile stress to the first and second main-span deck segments.

6. The partially earth-anchored cable-stayed bridge as set forth in claim 5, wherein: the first and second anchor units are installed on upper surfaces of the second and third main-span deck segments so as to be opposite to each other in at least one pair between the second and third main-span deck segments; and the second and third main-span deck segments are continuously connected in at least one pair such that the anchor units and the prestressing member are installed in the axial direction of the bridge in rows.

7. A fully earth-anchored cable-stayed bridge using a main-span prestressing unit comprising:

first and second main towers spaced a predetermined distance apart from each other in an axial direction of the bridge;

first and second anchorages on sides of side spans outside the first and second main towers;

tension cables, which extend from the first and second anchorages toward a main span via the first and second main towers, and are connected to first and second main-span deck segments, which are continuously installed from the first and second main towers to a middle part of the main span in sequence, such that a tensile stress is applied to each main-span deck segment;

(c) a prestressing member installed between first and second anchor units installed on the first and second main-span deck segments respectively and prestressed and anchored between the first and second anchor units, the first and second main-span deck segments, which are continuously installed from the first and second main towers, being connected to each other at the middle part of the main span; and side-span deck segments installed from the first and second main towers toward the side spans.

8. The fully earth-anchored cable-stayed bridge as set forth in claim 7, wherein: the first and second anchor units are installed on upper surfaces of the second and third main-span deck segments so as to be opposite to each other in at least one pair between the second and third main-span deck segments; and the second and third main-span deck segments are continuously connected in at least one pair such that the anchor units and the prestressing member are installed in the axial direction of the bridge in rows.

* * * * *